US008576260B2

(12) United States Patent
Saito et al.

(10) Patent No.: US 8,576,260 B2
(45) **Date of Patent: *Nov. 5, 2013**

(54) PLASMA DISPLAY DEVICE AND PLASMA DISPLAY PANEL DRIVING METHOD

(75) Inventors: Tomoyuki Saito, Osaka (JP); Takahiko Origuchi, Osaka (JP)

(73) Assignee: Panasonic Corporation, Osaka (JP)

( * ) Notice: Subject to any disclaimer, the term of this patent is extended or adjusted under 35 U.S.C. 154(b) by 260 days.

This patent is subject to a terminal disclaimer.

(21) Appl. No.: 13/127,609

(22) PCT Filed: Nov. 11, 2009

(86) PCT No.: PCT/JP2009/006003

§ 371 (c)(1),
(2), (4) Date: May 4, 2011

(87) PCT Pub. No.: WO2010/055644

PCT Pub. Date: May 20, 2010

(65) Prior Publication Data

US 2011/0210992 A1 Sep. 1, 2011

(30) Foreign Application Priority Data

Nov. 12, 2008 (JP) ..... 2008-289533

(51) Int. Cl.
*G09G 3/28* (2013.01)

(52) U.S. Cl.
USPC ..... 345/690; 345/60

(58) Field of Classification Search
USPC ..... 345/690, 60–72
See application file for complete search history.

(56) References Cited

U.S. PATENT DOCUMENTS

| | | | | |
|---|---|---|---|---|
| 7,091,934 | B2 * | 8/2006 | Kim et al. | 345/60 |
| 2002/0145575 | A1 | 10/2002 | Tong et al. | |
| 2004/0257310 | A1 * | 12/2004 | Yu et al. | 345/63 |
| 2005/0068265 | A1 * | 3/2005 | Joo et al. | 345/60 |
| 2005/0200571 | A1 * | 9/2005 | Gotoda et al. | 345/63 |

(Continued)

FOREIGN PATENT DOCUMENTS

| | | |
|---|---|---|
| JP | 2005-208369 A | 8/2005 |
| JP | 2005-257754 A | 9/2005 |

(Continued)

OTHER PUBLICATIONS

International Search Report for PCT/JP2009/006003, Feb. 9, 2010.

(Continued)

*Primary Examiner* — Dorothy Harris
(74) *Attorney, Agent, or Firm* — RatnerPrestia

(57) ABSTRACT

The image display quality is improved by uniforming the display luminance. For that purpose, the plasma display device has a plasma display panel, and image signal processing circuit. Image signal processing circuit includes loading correcting section. Section includes number-of-lit-cells calculating section for calculating the number of discharge cells to be lit for each display electrode pair in each subfield, load value calculating section for calculating the load value of each discharge cell based on the calculation result by number-of-lit-cells calculating section, correction gain calculating section for calculating the correction gain of each discharge cell based on the calculation result by load value calculating section and the positions of the discharge cells, and correcting section for subtracting, from an input image signal, the result derived by multiplying the input image signal by the output from correction gain calculating section.

2 Claims, 13 Drawing Sheets

(56) References Cited

U.S. PATENT DOCUMENTS

| | | | | |
|---|---|---|---|---|
| 2005/0248594 | A1* | 11/2005 | Usui et al. | 345/690 |
| 2006/0132659 | A1 | 6/2006 | Kimura et al. | |
| 2011/0210991 | A1* | 9/2011 | Origuchi et al. | 345/690 |
| 2011/0216108 | A1* | 9/2011 | Origuchi et al. | 345/690 |

FOREIGN PATENT DOCUMENTS

| | | | |
|---|---|---|---|
| JP | 2006-184843 | A | 7/2006 |
| JP | 2006-301555 | A | 11/2006 |
| JP | 2006-301555 | A | 11/2006 |
| JP | 2006-301556 | A | 11/2006 |
| JP | 2006-301556 | A | 11/2006 |
| JP | 2006-337720 | A | 12/2006 |
| JP | 2006-337720 | A | 12/2006 |
| JP | 2008-145880 | A | 6/2008 |

OTHER PUBLICATIONS

European Search Report for European Patent Application No. 09825898 dated May 30, 2012.

Chinese Office Action for Application No. 200980145088.3 dated Mar. 27, 2013.

* cited by examiner

121

| | | | | | | | | | | | | | | | |
|---|---|---|---|---|---|---|---|---|---|---|---|---|---|---|---|
| First SF | 1 | 1 | 1 | 1 | 1 | 1 | 1 | 1 | 1 | 1 | 1 | 1 | 1 | 1 | 1 |
| Second SF | 1 | 1 | 1 | 1 | 1 | 1 | 1 | 1 | 1 | 1 | 1 | 1 | 1 | 1 | 1 |
| Third SF | 1 | 1 | 1 | 1 | 1 | 1 | 1 | 1 | 1 | 1 | 1 | 1 | 1 | 1 | 1 |
| Fourth SF | 1 | 1 | 1 | 1 | 1 | | | | | | 1 | 1 | 1 | 1 | 1 |
| Fifth SF | 1 | 1 | 1 | 1 | 1 | | | | | | 1 | 1 | 1 | 1 | 1 |
| Sixth SF | 1 | 1 | 1 | 1 | 1 | | | | | | 1 | 1 | 1 | 1 | 1 |
| Seventh SF | | | | | | | | | | | | | | | |
| Eighth SF | | | | | | | | | | | | | | | |

122

| | Number of lit cells | Luminance weight | Lit state of discharge cell B | Calculation value |
|---|---|---|---|---|
| First SF | 15 | 1 | 1 | 15 |
| Second SF | 15 | 2 | 1 | 30 |
| Third SF | 15 | 4 | 1 | 60 |
| Fourth SF | 10 | 8 | 1 | 80 |
| Fifth SF | 10 | 16 | 1 | 160 |
| Sixth SF | 10 | 32 | 1 | 320 |
| Seventh SF | 0 | 64 | 0 | 0 |
| Eighth SF | 0 | 128 | 0 | 0 |

| | |
|---|---|
| Sum total of calculation values | 665 |

131

| | | | | | | | | | | | | | | | |
|---|---|---|---|---|---|---|---|---|---|---|---|---|---|---|---|
| First SF | 1 | 1 | 1 | 1 | 1 | 1 | 1 | 1 | 1 | 1 | 1 | 1 | 1 | 1 | 1 |
| Second SF | 1 | 1 | 1 | 1 | 1 | 1 | 1 | 1 | 1 | 1 | 1 | 1 | 1 | 1 | 1 |
| Third SF | 1 | 1 | 1 | 1 | 1 | 1 | 1 | 1 | 1 | 1 | 1 | 1 | 1 | 1 | 1 |
| Fourth SF | 1 | 1 | 1 | 1 | 1 | 1 | 1 | 1 | 1 | 1 | 1 | 1 | 1 | 1 | 1 |
| Fifth SF | 1 | 1 | 1 | 1 | 1 | 1 | 1 | 1 | 1 | 1 | 1 | 1 | 1 | 1 | 1 |
| Sixth SF | 1 | 1 | 1 | 1 | 1 | 1 | 1 | 1 | 1 | 1 | 1 | 1 | 1 | 1 | 1 |
| Seventh SF | | | | | | | | | | | | | | | |
| Eighth SF | | | | | | | | | | | | | | | |

132

| | Number of lit cells | Luminance weight | Lit state of discharge cell B | Calculation value |
|---|---|---|---|---|
| First SF | 15 | 1 | 1 | 15 |
| Second SF | 15 | 2 | 1 | 30 |
| Third SF | 15 | 4 | 1 | 60 |
| Fourth SF | 15 | 8 | 1 | 120 |
| Fifth SF | 15 | 16 | 1 | 240 |
| Sixth SF | 15 | 32 | 1 | 480 |
| Seventh SF | 0 | 64 | 0 | 0 |
| Eighth SF | 0 | 128 | 0 | 0 |

| | |
|---|---|
| Sum total of calculation values | 945 |

PLASMA DISPLAY DEVICE AND PLASMA DISPLAY PANEL DRIVING METHOD

This application is a U.S. National Phase Application of PCT International Application PCT/JP2009/006003.

TECHNICAL FIELD

The present invention relates to a plasma display device used in a wall-mounted television or a large monitor, and a driving method for a plasma display panel.

BACKGROUND ART

An alternating-current surface discharge type panel typical as a plasma display panel (hereinafter referred to as "panel") has many discharge cells between a front plate and a rear plate that are faced to each other. The front plate has the following elements:

- a plurality of display electrode pairs disposed in parallel on a front glass substrate; and
- a dielectric layer and a protective layer for covering the display electrode pairs.

Here, each display electrode pair is formed of a pair of scan electrode and sustain electrode. The rear plate has the following elements:

- a plurality of data electrodes disposed in parallel on a rear glass substrate;
- a dielectric layer for covering the data electrodes;
- a plurality of barrier ribs disposed on the dielectric layer in parallel with the data electrodes; and
- phosphor layers disposed on the surface of the dielectric layer and on side surfaces of the barrier ribs.

The front plate and rear plate are faced to each other so that the display electrode pairs and the data electrodes three-dimensionally intersect, and are sealed. Discharge gas containing xenon with a partial pressure of 5%, for example, is filled into a discharge space in the sealed product. Discharge cells are disposed in intersecting parts of the display electrode pairs and the data electrodes. In the panel having this structure, ultraviolet rays are emitted by gas discharge in each discharge cell. The ultraviolet rays excite respective phosphors of red (R), green (G), and blue (B) to emit light, and thus provide color display.

A subfield method is generally used as a method of driving the panel. In this method, one field is divided into a plurality of subfields, and the subfields in which light is emitted are combined, thereby performing gradation display.

Each subfield has an initializing period, an address period, and a sustain period. In the initializing period, an initializing waveform is applied to each scan electrode, and initializing discharge is caused in each discharge cell. Thus, wall charge required for a subsequent address operation is formed on each discharge cell, and a priming particle (an excitation particle for causing address discharge) for stably causing address discharge is generated.

In the address period, a scan pulse is sequentially applied to scan electrodes (hereinafter, this operation is referred to as "scan"), and an address pulse corresponding to an image signal to be displayed is selectively applied to data electrodes (hereinafter, this operation is referred to as "address"). Thus, address discharge is selectively caused between the scan electrodes and the data electrodes, thereby selectively producing wall charge.

In a sustain period, as many sustain pulses as a predetermined number corresponding to the luminance to be displayed are alternately applied to the display electrode pairs formed of the scan electrodes and the sustain electrodes. Thus, sustain discharge is selectively caused in the discharge cell where wall charge has been produced by address discharge, thereby emitting light in this discharge cell (hereinafter, sustain light emission in a discharge cell is referred to as "lighting", and no sustain light emission in a discharge cell is referred to as "no-lighting"). An image is displayed in a display region of a panel.

In this subfield method, for example, in the initializing period of one of a plurality of subfields, the all-cell initializing operation of causing discharge in all discharge cells is performed. In the initializing period of other subfields, the selective initializing operation of selectively causing initializing discharge is performed in the discharge cell that has undergone sustain discharge. As a result, light emission that is not related to the gradation display can be minimized, and the contrast ratio can be improved.

As the screen of the panel has been enlarged and the definition of the panel has been enhanced, recently, the image display quality in a plasma display device has been demanded to be further improved. When the driving impedance changes between the display electrode pairs, however, the voltage drop of the driving voltage can change, and the emission luminance can change between image signals though the image signals have the same luminance.

Therefore, a technology of changing the lighting pattern of the subfields in one field when the driving impedance changes between the display electrode pairs is disclosed (for example, patent literature 1).

As the screen of the panel has been enlarged and the definition of the panel has been enhanced, the driving impedance of the panel is apt to increase. The difference in voltage drop of the driving voltage between a discharge cell formed near a driving circuit and a discharge cell formed far from the driving circuit is apt to increase even when the discharge cells are formed on the same display electrode pair.

In the technology disclosed in patent literature 1, however, it is difficult to reduce the difference in the emission luminance that is caused by the difference in voltage drop of the driving voltage between the discharge cell formed near the driving circuit and the discharge cell formed far from the driving circuit.

CITATION LIST

Patent Literature

[Patent Literature 1] Unexamined Japanese Patent Publication No. 2006-184843

SUMMARY OF THE INVENTION

The plasma display device of the present invention has the following elements:

- a panel that is driven by a subfield method, and has a plurality of discharge cells including a display electrode pair that is formed of a scan electrode and a sustain electrode; and
- an image signal processing circuit for converting an input image signal into image data that indicates light emission or no light emission in each subfield in a discharge cell.

Here, in this subfield method, a plurality of subfields having an initializing period, an address period, and a sustain period is disposed in one field, a luminance weight is set for each subfield, and as many sustain pulses as the number corresponding to the luminance weight in the sustain period are generated, thereby performing gradation display. The image signal processing circuit includes the following elements:

- a number-of-lit-cells calculating section for calculating the number of cells to be lit for each display electrode pair in each subfield;
- a load value calculating section for calculating the load value of each discharge cell based on the calculation result by the number-of-lit-cells calculating section;
- a correction gain calculating section for calculating the correction gain of each discharge cell based on the calculation result by the load value calculating section and the position of the discharge cell; and
- a correcting section for subtracting, from the input image signal, the result derived by multiplying the input image signal by the output from the correction gain calculating section.

Thus, loading correction can be performed using the correction gain corresponding to the position of the discharge cell. Therefore, even when the voltage drop of the sustain pulse changes between discharge cells formed on the same display electrode pair, display luminance can be uniformed and the image display quality can be improved.

DETAILED DESCRIPTION OF PREFERRED EMBODIMENTS

A plasma display device in accordance with an exemplary embodiment of the present invention will be described hereinafter with reference to the accompanying drawings.

Exemplary Embodiment

Figure 1:
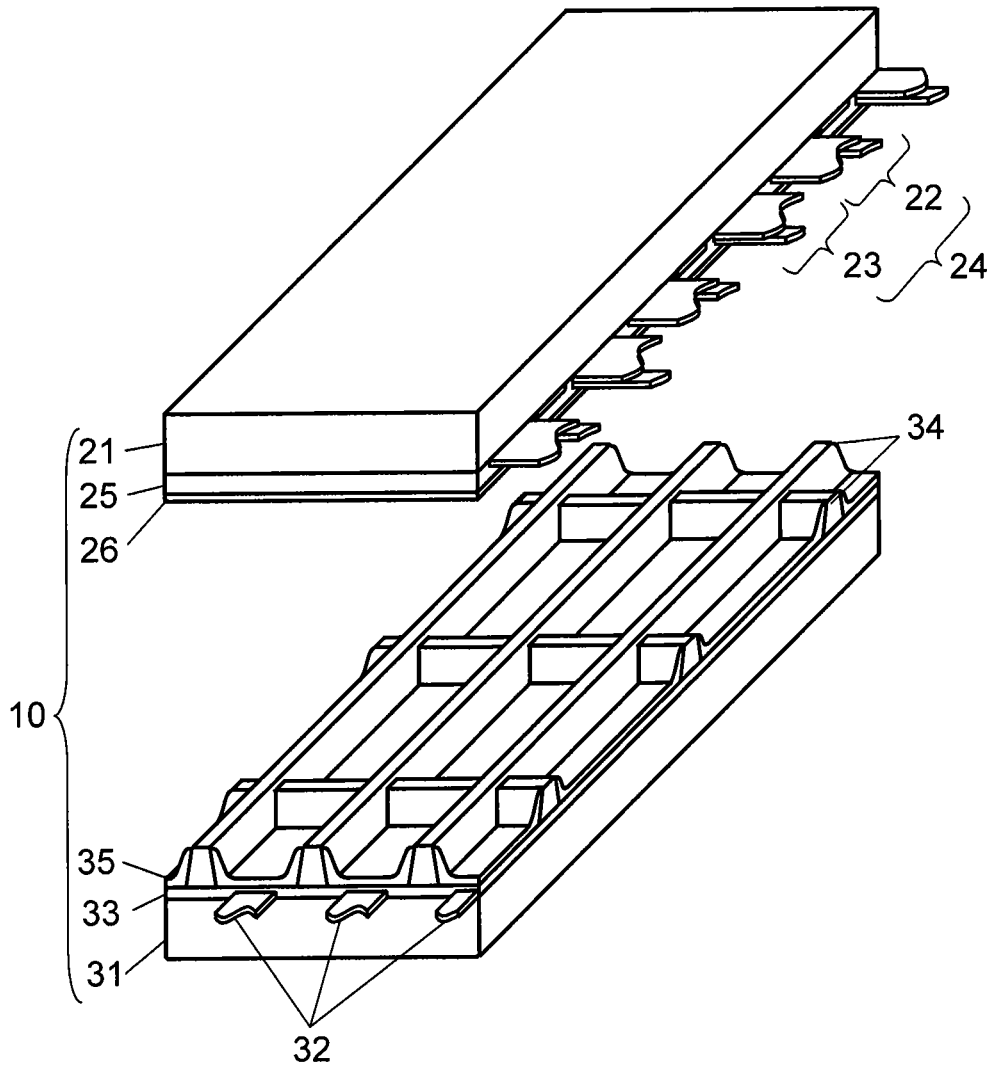
FIG. 1 is an exploded perspective view showing a structure of a panel in accordance with an exemplary embodiment of the present invention.

FIG. 1 is an exploded perspective view showing a structure of panel 10 in accordance with the exemplary embodiment of the present invention. A plurality of display electrode pairs 24 formed of scan electrodes 22 and sustain electrodes 23 is disposed on glass-made front plate 21. Dielectric layer 25 is formed so as to cover scan electrodes 22 and sustain electrodes 23, and protective layer 26 is formed on dielectric layer 25.

Protective layer 26 is made of a material mainly made of MgO. This material is actually used as a material of the panel in order to reduce the discharge start voltage in a discharge cell, and has a large secondary electron discharge coefficient and high durability when neon (Ne) and xenon (Xe) gases are filled.

A plurality of data electrodes 32 is formed on rear plate 31, dielectric layer 33 is formed so as to cover data electrodes 32, and mesh barrier ribs 34 are formed on dielectric layer 33. Phosphor layers 35 for emitting lights of respective colors of red (R), green (G), and blue (B) are formed on the side surfaces of barrier ribs 34 and on dielectric layer 33.

Front plate 21 and rear plate 31 are faced to each other so that display electrode pairs 24 cross data electrodes 32 with a micro discharge space sandwiched between them, and the outer peripheries of them are sealed by a sealing material such as glass frit. The discharge space is filled with mixed gas of neon and xenon as discharge gas. In the present embodiment, discharge gas where xenon partial pressure is set at about 10% is employed for improving the luminous efficiency. The discharge space is partitioned into a plurality of sections by barrier ribs 34. Discharge cells are formed in the intersecting parts of display electrode pairs 24 and data electrodes 32. The discharge cells discharge and emit light (lighting) to display an image. In panel 10, one pixel is formed of three discharge cells emitting lights of respective colors of R, G, and B.

The structure of panel 10 is not limited to the above-mentioned one, but may be a structure having striped barrier ribs, for example. The mixing ratio of the discharge gas is not limited to the above-mentioned numerical value, but may be another mixing ratio.

Figure 2:
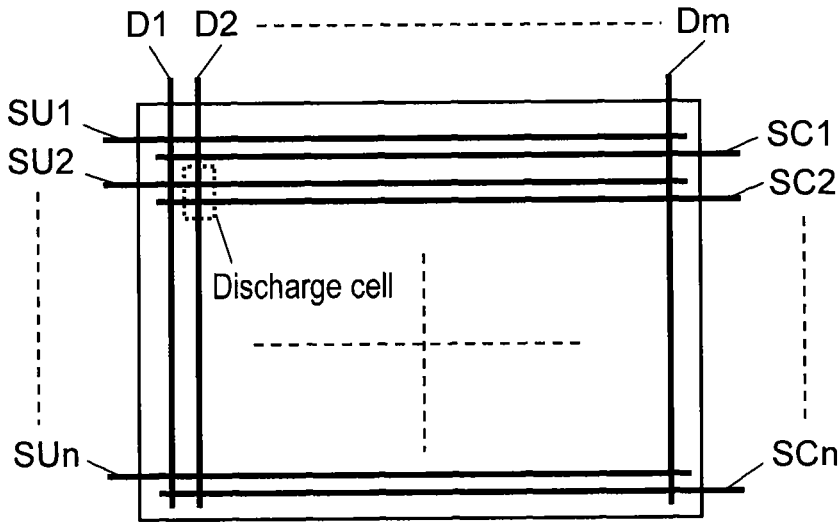
FIG. 2 is an electrode array diagram of the panel.

FIG. 2 is an electrode array diagram of panel 10 in accordance with the exemplary embodiment of the present invention. Panel 10 has n scan electrode SC1 through scan electrode SCn (scan electrodes 22 in FIG. 1) and n sustain electrode SU1 through sustain electrode SUn (sustain electrodes 23 in FIG. 1) both extended in the row direction, and m data electrode D1 through data electrode Dm (data electrodes 32 in FIG. 1) extended in the column direction. A discharge cell is formed in the part where a pair of scan electrode SCi (i is 1 through n) and sustain electrode SUi intersect with one data electrode Dj (j is 1 through m). Thus, m×n discharge cells are formed in the discharge space. The region where m×n discharge cells are formed becomes a display region of panel 10.

Next, a driving voltage waveform and its operation for driving panel 10 are described schematically. The plasma display device of the present embodiment performs gradation display by a subfield method. In other words, the plasma display device divides one field into a plurality of subfields on the time axis, sets luminance weight for each subfield, and controls light emission and no light emission of each discharge cell in each subfield, thereby performing the gradation display.

In this subfield method, for example, one field is formed of 8 subfields (first SF, second SF, . . . , eighth SF), and respective subfields have luminance weights of (1, 2, 4, 8, 16, 32, 64, 128). In the initializing period of one subfield, of a plurality of subfields, all-cell initializing operation of causing the initializing discharge in all discharge cells is performed (hereinafter, a subfield where all-cell initializing operation is performed is referred to as "all-cell initializing subfield"). In the initializing period of the other subfields, selective initializing operation of selectively causing the initializing discharge in the discharge cell that has undergone sustain discharge is performed (hereinafter, a subfield where selective initializing operation is performed is referred to as "selective initializing subfield"). Thus, light emission related to no gradation display can be minimized and the contrast ratio can be increased.

In the present embodiment, all-cell initializing operation is performed in the initializing period of the first SF, and selective initializing operation is performed in the initializing periods of the second SF through eighth SF. Thus, light emission related to no image display is only light emission following the discharge of the all-cell initializing operation in the first SF. The luminance of black level, which is luminance in a black display region that does not cause sustain discharge, is therefore determined only by weak light emission in the all-cell initializing operation. This allows image display of sharp contrast. In a sustain period of each subfield, as many sustain pulses as the number derived by multiplying the luminance weight of each subfield by a predetermined proportionality constant are applied to each display electrode pair 24. The proportionality constant is luminance magnification.

In the present embodiment, the number of subfields and luminance weight of each subfield are not limited to the above-mentioned values. The subfield structure may be changed based on an image signal or the like.

Figure 3:
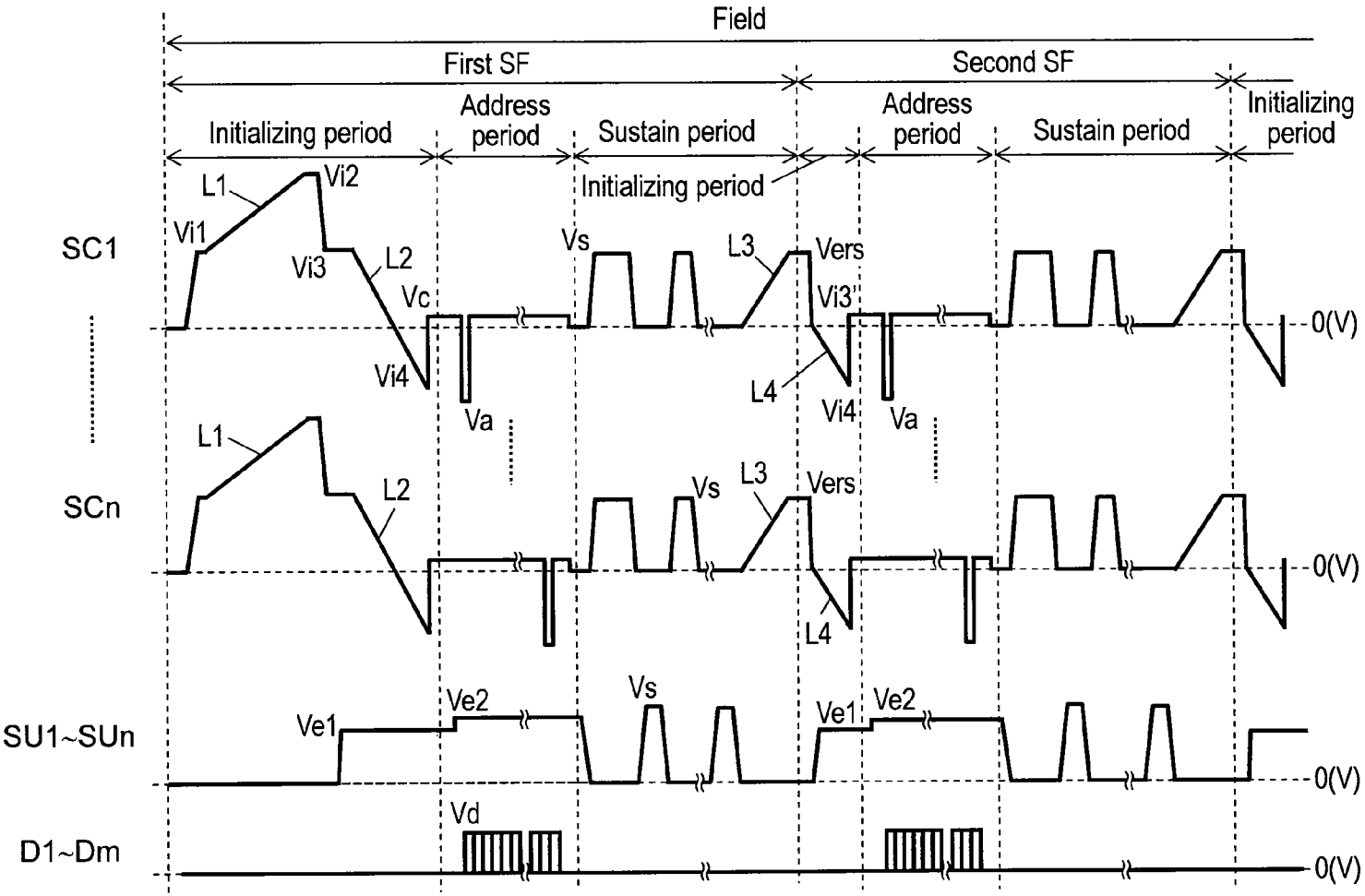
FIG. 3 is a waveform chart of driving voltage to be applied to each electrode of the panel

FIG. 3 is a waveform chart of driving voltage applied to each electrode of panel 10 in accordance with the exemplary embodiment of the present invention. FIG. 3 shows driving waveforms of scan electrode SC1 for firstly performing a scan in the address period, scan electrode SCn for finally performing a scan in the address period, sustain electrode SU1 through sustain electrode SUn, and data electrode D1 through data electrode Dm.

FIG. 3 shows driving voltage waveforms of two subfields, namely a first subfield (first SF), which is an all-cell initializing subfield, and a second subfield (second SF), which is a selective initializing subfield. The driving voltage waveforms in other subfields are substantially similar to the driving voltage waveform in the second SF except that the number of sustain pulses in the sustain period is changed. Scan electrode SCi, sustain electrode SUi, and data electrode Dk described later are selected from the electrodes based on image data (data indicating light emission or no light emission for each subfield).

First, a first SF as the all-cell initializing subfield is described.

In the first half of the initializing period of the first SF, 0 (V) is applied to data electrode D1 through data electrode Dm and sustain electrode SU1 through sustain electrode SUn, and ramp voltage (hereinafter referred to as "up-ramp voltage") L1 is applied to scan electrode SC1 through scan electrode SCn. Here, up-ramp voltage L1 gradually (at a gradient of about 1.3 Vh/μsec, for example) increases from voltage Vi1, which is not higher than a discharge start voltage, to voltage Vi2, which is higher than the discharge start voltage, with respect to sustain electrode SU1 through sustain electrode SUn.

While up-ramp voltage L1 increases, feeble initializing discharge continuously occurs between scan electrode SC1 through scan electrode SCn and sustain electrode SU1 through sustain electrode SUn, and feeble initializing discharge continuously occurs between scan electrode SC1 through scan electrode SCn and data electrode D1 through data electrode Dm. Negative wall voltage is accumulated on scan electrode SC1 through scan electrode SCn, and positive wall voltage is accumulated on data electrode D1 through data electrode Dm and sustain electrode SU1 through sustain electrode SUn. The wall voltage on the electrodes means voltage generated by the wall charge accumulated on the dielectric layer for covering the electrodes, the protective layer, or the phosphor layers.

In the latter half of the initializing period, positive voltage Ve1 is applied to sustain electrode SU1 through sustain electrode SUn, and 0 (V) is applied to data electrode D1 through data electrode Dm. Ramp voltage (hereinafter referred to as "down-ramp voltage") L2 is applied to scan electrode SC1 through scan electrode SCn. Here, down-ramp voltage L2 gradually decreases from voltage Vi3, which is not higher than the discharge start voltage, to voltage Vi4, which is higher than the discharge start voltage, with respect to sustain electrode SU1 through sustain electrode SUn.

While down-ramp voltage L2 decreases, feeble initializing discharge occurs between scan electrode SC1 through scan electrode SCn and sustain electrode SU1 through sustain electrode SUn, and feeble initializing discharge occurs between scan electrode SC1 through scan electrode SCn and data electrode D1 through data electrode Dm. The negative wall voltage on scan electrode SC1 through scan electrode SCn and the positive wall voltage on sustain electrode SU1 through sustain electrode SUn are reduced. The positive wall voltage on data electrode D1 through data electrode Dm is adjusted to a value appropriate for address operation. Thus, the all-cell initializing operation of performing initializing discharge in all discharge cells is completed.

As shown in the initializing period of the second SF of FIG. 3, a driving voltage waveform, in which the first half part of the initializing period is omitted, may be applied to each electrode. In other words, voltage Ve1 is applied to sustain electrode SU1 through sustain electrode SUn, 0 (V) is applied to data electrode D1 through data electrode Dm, and down-ramp voltage L4 is applied to scan electrode SC1 through scan electrode SCn. Here, down-ramp voltage L4 gradually decreases from voltage (for example, ground potential), which is not higher than the discharge start voltage, to voltage V14. Thus, in the discharge cell having undergone sustain discharge in the sustain period of the immediately preceding subfield (first SF in FIG. 3), feeble initializing discharge occurs, the wall voltage on scan electrode SCi and sustain electrode SUi is reduced, and wall voltage on data electrode Dk (k is 1 through m) is adjusted to a value appropriate for address operation by discharge of excessive part.

While, in the discharge cell having undergone no sustain discharge in the immediately preceding subfield, discharge does not occur, and the state of the wall charge at the completion of the initializing period of the immediately preceding subfield is kept as it is. Thus, the initializing operation in which the first half part is omitted is selective initializing operation of performing initializing discharge in the discharge cell that has undergone sustain operation in the sustain period of the immediately preceding subfield.

In the subsequent address period, scan pulse voltage Va is sequentially applied to scan electrode SC1 through scan electrode SCn, and positive address pulse voltage Vd is applied to data electrode Dk (k is 1 through m) corresponding to the discharge cell to emit light, of data electrode D1 through data electrode Dm, thereby selectively causing address discharge in each discharge cell.

In the address period, voltage Ve2 is firstly applied to sustain electrode SU1 through sustain electrode SUn, and voltage Vc is applied to scan electrode SC1 through scan electrode SCn.

Then, negative scan pulse voltage Va is applied to scan electrode SC1 in the first row, positive address pulse voltage Vd is applied to data electrode Dk (k is 1 through m) in the discharge cell to emit light in the first row, of data electrode D1 through data electrode Dm. At this time, the voltage difference in the intersecting part of data electrode Dk and scan electrode SC1 is derived by adding the difference between the wall voltage on data electrode Dk and that on scan electrode SC1 to the difference (voltage Vd−voltage Va) of the external applied voltage, and exceeds the discharge start voltage.

Discharge thus occurs between data electrode Dk and scan electrode SC1. Since voltage Ve2 is applied to sustain electrode SU1 through sustain electrode SUn, the voltage difference between sustain electrode SU1 and scan electrode SC1 is derived by adding the difference between the wall voltage on sustain electrode SU1 and that on scan electrode SC1 to the difference (voltage Ve2−voltage Va) of the external applied voltage. At this time, by setting voltage Ve2 at a voltage value slightly lower than the discharge start voltage, a state where discharge does not occur but is apt to occur can be caused between sustain electrode SU1 and scan electrode SC1.

Therefore, the discharge occurring between data electrode Dk and scan electrode SC1 can cause discharge between sustain electrode SU1 and scan electrode SC1 that exist in a region crossing data electrode Dk. Thus, address discharge occurs in the discharge cell to emit light, positive wall voltage is accumulated on scan electrode SC1, negative wall voltage is accumulated on sustain electrode SU1, and negative wall voltage is also accumulated on data electrode Dk.

Thus, address operation of causing address discharge in the discharge cell to emit light in the first row and accumulating wall voltage on each electrode is performed. The voltage in the parts where scan electrode SC1 intersects with data electrode D1 through data electrode Dm to which address pulse voltage Vd is not applied does not exceed the discharge start voltage, so that address discharge does not occur. This address operation is performed until it reaches the discharge cell in the n-th row, and the address period is completed.

In the subsequent sustain period, as many sustain pulses as the number derived by multiplying the luminance weight by a predetermined luminance magnification are alternately applied to display electrode pairs 24, sustain discharge is caused to emit light in the discharge cell having undergone the address discharge.

In the sustain period, positive sustain pulse voltage Vs is firstly applied to scan electrode SC1 through scan electrode SCn, and the ground potential as a base potential, namely 0 (V), is applied to sustain electrode SU1 through sustain electrode SUn. In the discharge cell having undergone the address discharge, the voltage difference between scan electrode SCi and sustain electrode SUi is obtained by adding the difference between the wall voltage on scan electrode SCi and that on sustain electrode SUi to sustain pulse voltage Vs, and exceeds the discharge start voltage.

Thus, sustain discharge occurs between scan electrode SCi and sustain electrode SUi, and ultraviolet rays generated at this time cause phosphor layer 35 to emit light. Negative wall voltage is accumulated on scan electrode SCi, and positive wall voltage is accumulated on sustain electrode SUi. Positive wall voltage is also accumulated on data electrode Dk. In the discharge cell where address discharge has not occurred in the address period, sustain discharge does not occur and the wall voltage at the end of the initializing period is kept.

Subsequently, 0 (V) as the base potential is applied to scan electrode SC1 through scan electrode SCn, and sustain pulse voltage Vs is applied to sustain electrode SU1 through sustain electrode SUn. In the discharge cell having undergone the sustain discharge, the voltage difference between sustain electrode SUi and scan electrode SCi exceeds the discharge start voltage, so that sustain discharge occurs between sustain electrode SUi and scan electrode SCi again. Therefore, negative wall voltage is accumulated on sustain electrode SUi, and positive wall voltage is accumulated on scan electrode SCi. Hereinafter, similarly, as many sustain pulses as the number derived by multiplying the luminance weight by luminance magnification are alternately applied to scan electrode SC1 through scan electrode SCn and sustain electrode SU1 through sustain electrode SUn to cause potential difference between the electrodes of display electrode pairs 24. Thus, sustain discharge is continuously performed in the discharge cell where the address discharge has been caused in the address period.

After generation of a sustain pulse in the sustain period, ramp voltage (hereinafter referred to as "erasing ramp voltage") L3, which gradually increases from 0 (V) to voltage Vers, is applied to scan electrode SC1 through scan electrode SCn. Thus, in the discharge cell having undergone the sustain discharge, feeble discharge is continuously caused, a part or the whole of the wall voltage on scan electrode SCi and sustain electrode SUi is erased while positive wall voltage is left on data electrode Dk.

Each operation of the second SF and later is substantially the same as the above-mentioned operation except for the number of sustain pulses in the sustain period, and hence is not described. The outline of the driving voltage waveform applied to each electrode of panel 10 of the present embodiment has been described.

Figure 4:
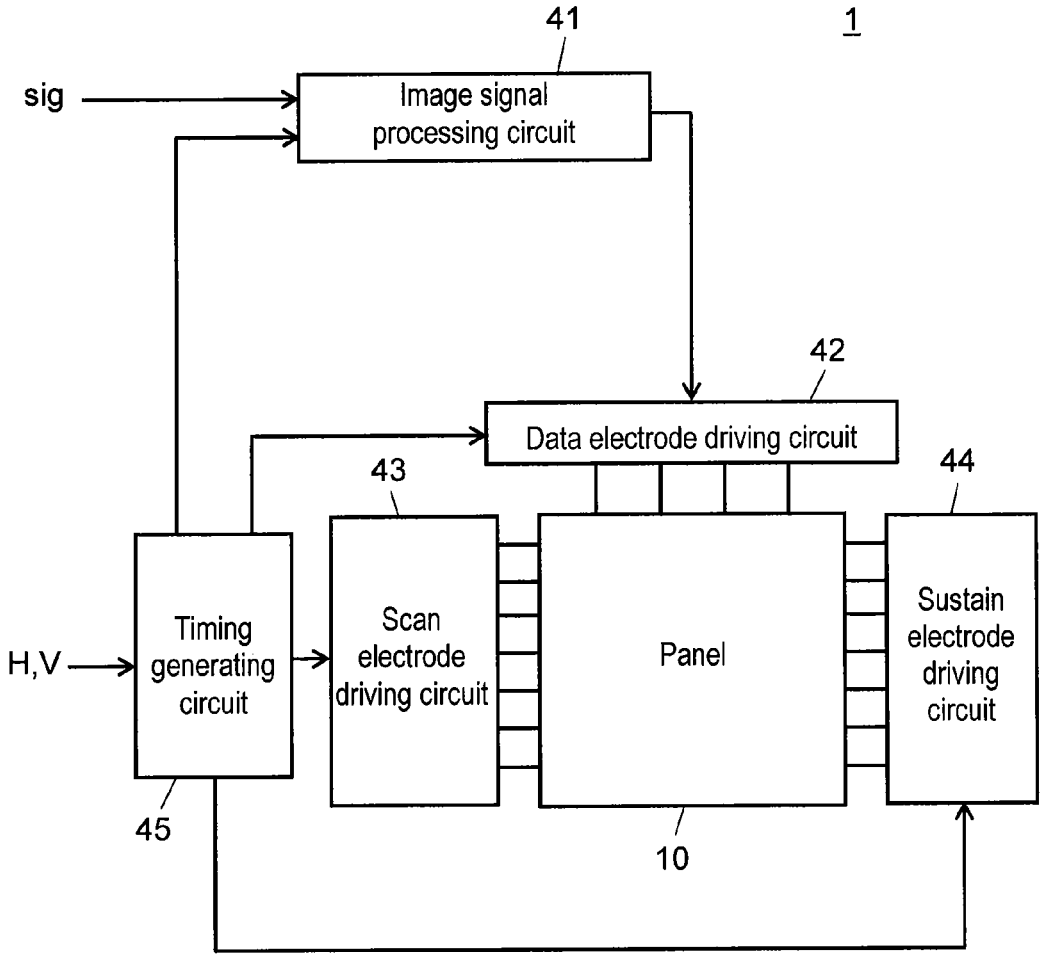
FIG. 4 is a circuit block diagram of a plasma display device in accordance with the exemplary embodiment of the present invention.

Next, a configuration of the plasma display device of the present embodiment is described. FIG. 4 is a circuit block diagram of plasma display device 1 of the exemplary embodiment of the present invention. Plasma display device 1 has the following elements:

panel 10;
image signal processing circuit 41;
data electrode driving circuit 42;
scan electrode driving circuit 43;
sustain electrode driving circuit 44;
timing generating circuit 45; and
a power supply circuit (not shown) for supplying power required for each circuit block.

Image signal processing circuit 41 converts input image signal sig into image data that indicates light emission or no light emission in each subfield in the discharge cell.

Timing generating circuit 45 generates various timing signals for controlling operations of respective circuit blocks based on horizontal synchronizing signal H and vertical synchronizing signal V. Timing generating circuit 45 supplies the timing signals to respective circuit blocks.

Scan electrode driving circuit 43 has an initializing waveform generating circuit, a sustain pulse generating circuit, and a scan pulse generating circuit (not shown). The initializing waveform generating circuit generates an initializing waveform voltage to be applied to scan electrode SC1 through scan electrode SCn in the initializing period. The sustain pulse generating circuit generates a sustain pulse to be applied to scan electrode SC1 through scan electrode SCn in the sustain period. The scan pulse generating circuit has a plurality of scan ICs, and generates scan pulse voltage Va to be applied to scan electrode SC1 through scan electrode SCn in the address period. Scan electrode driving circuit 43 drives each of scan electrode SC1 through scan electrode SCn based on the timing signal.

Data electrode driving circuit 42 converts the image data in each subfield into a signal corresponding to each of data electrode D1 through data electrode Dm, and drives each of data electrode D1 through data electrode Dm based on the timing signal.

Sustain electrode driving circuit 44 has a sustain pulse generating circuit and a circuit (not shown) for generating voltage Ve1 and voltage Vet, and drives sustain electrode SU1 through sustain electrode SUn based on the image data and the timing signal.

Next, difference in emission luminance caused by variation in driving load is described.

Figure 5A:
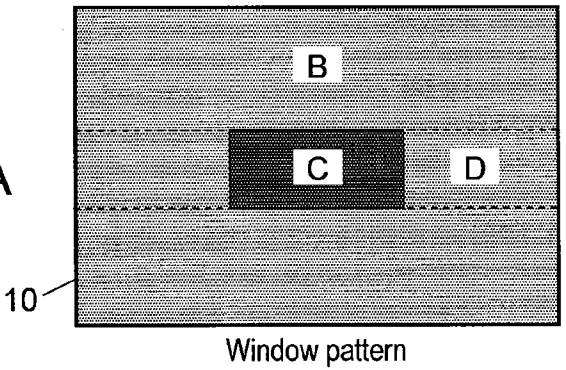
FIG. 5A is a schematic diagram for illustrating a difference in emission luminance caused by variation in driving load.
Figure 5B:
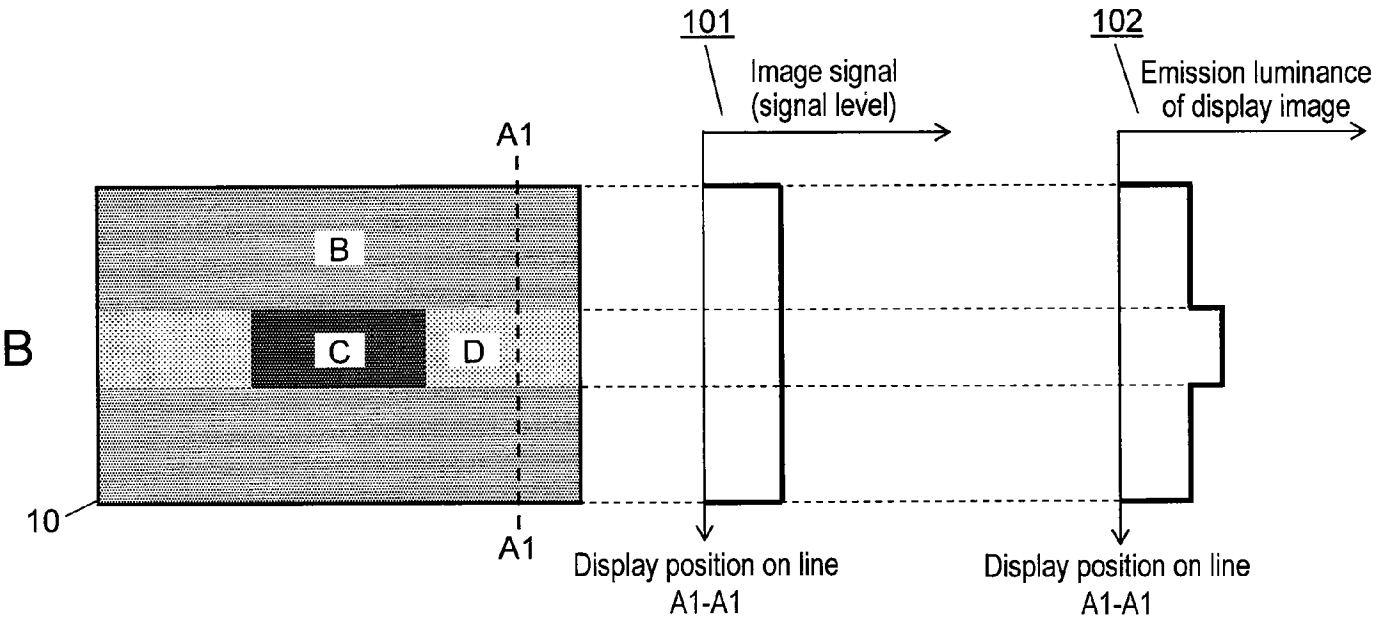
FIG. 5B is a schematic diagram for illustrating another difference in emission luminance caused by variation in driving load.
Figure 6A:
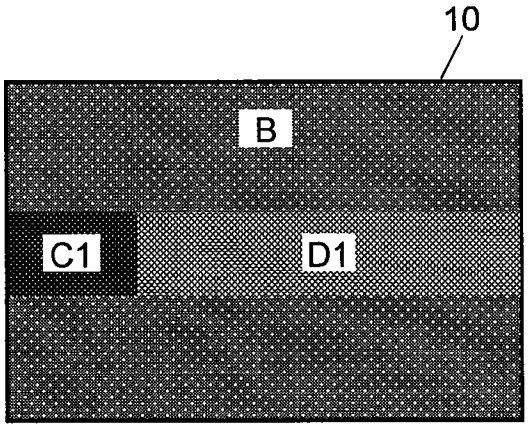
FIG. 6A is a diagram for schematically illustrating a loading phenomenon.
Figure 6B:
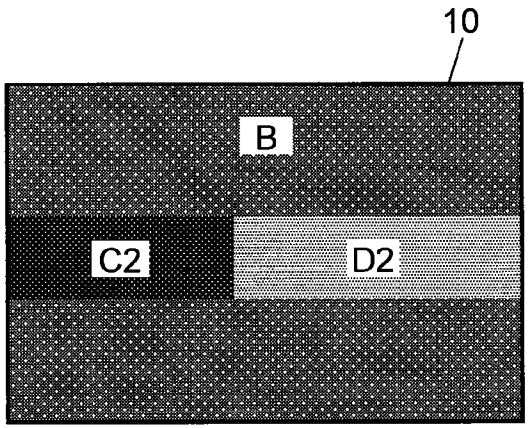
FIG. 6B is a diagram for schematically illustrating another loading phenomenon.
Figure 6C:
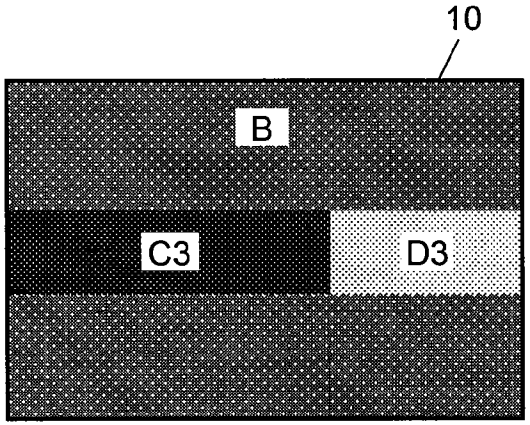
FIG. 6C is a diagram for schematically illustrating yet another loading phenomenon.
Figure 6D:
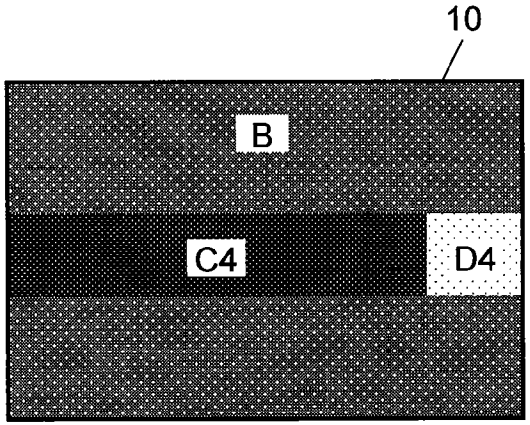
FIG. 6D is a diagram for schematically illustrating still another loading phenomenon.

FIG. 5A and FIG. 5B are schematic diagrams for illustrating the difference in emission luminance caused by the variation in driving load. FIG. 5A shows an ideal display image when an image generally referred to as "window pattern" is displayed on panel 10. Region B and region D of the drawings have the same signal level (for example, 20%), and region C has a signal level (for example, 5%) lower than that of region B and region D. "Signal level" used in the present embodiment may be the gradation value of a luminance signal, or may be the gradation value of the R signal, the gradation value of the B signal, or the gradation value of the G signal.

FIG. 5B is a schematic diagram of the display image when "window pattern" of FIG. 5A is displayed on panel 10, and shows signal level 101 and emission luminance 102. In panel 10 of FIG. 5B, display electrode pairs 24 are extended in the row direction (lateral direction in the drawings) similarly to panel 10 of FIG. 2. Signal level 101 of FIG. 5B shows the signal level of the image signal on line A1-A1 shown on panel 10 of FIG. 5B. The horizontal axis shows the height of the signal level of the image signal, and the vertical axis shows the display position on line A1-A1 on panel 10. Emission luminance 102 of FIG. 5B shows the emission luminance of the display image on line A1-A1 shown on panel 10 of FIG. 5B. The horizontal axis shows the height of the emission luminance of the display image, and the vertical axis shows the display position on line A1-A1 on panel 10.

When "window pattern" is displayed on panel 10 as shown in FIG. 5B, the emission luminance in region B can become different from that in region D as shown by emission luminance 102 though region B and region D have the same signal level as shown by signal level 101. This is considered for the following reason.

Display electrode pairs 24 are arranged while being extended in the row direction (lateral direction in the drawings). Therefore, when "window pattern" is displayed on panel 10 as shown in panel 10 of FIG. 5B, display electrode pairs 24 passing only region B and display electrode pairs 24 passing region C and region D occur. The driving load of display electrode pairs 24 passing region C and region D is smaller than the driving load of display electrode pairs 24 passing region B. This is because the signal level of region C is low and hence the discharge current flowing through display electrode pairs 24 passing region C and region D is smaller than the discharge current flowing through display electrode pairs 24 passing region B.

Therefore, in display electrode pairs 24 passing region C and region D, the voltage drop of the driving voltage, for example the voltage drop of the sustain pulse, becomes smaller than that in display electrode pairs 24 passing region B. In other words, the following phenomenon is considered: the voltage drop of the sustain pulse in display electrode pairs 24 passing region C and region D becomes smaller than that in display electrode pairs 24 passing region B, and the sustain discharge in the discharge cells included in region D has a discharge intensity higher than that of the sustain discharge in the discharge cells included in region B. As a result, it is considered that the emission luminance in region D is higher than that in region B though the signal levels in both regions are the same. Such as phenomenon is referred to as "loading phenomenon".

FIG. 6A, FIG. 6B, FIG. 6C, and FIG. 6D are diagrams for schematically illustrating the loading phenomenon. They schematically show the display image displayed on panel 10 while the area of region C where the signal level is low (for example, 5%) in "window pattern" gradually varies. Region D1 in FIG. 6A, region D2 in FIG. 6B, region D3 in FIG. 6C, and region D4 in FIG. 6D have the same signal level (for example, 20%) as that of region B As shown in FIG. 6A, FIG. 6B, FIG. 6C, and FIG. 6D, as the area of region C increases in the order of region C1, region C2, region C3, and region C4, the driving load of display electrode pairs 24 passing region C and region D decreases. As a result, the discharge intensity of the discharge cells included in region D, and the emission luminance in region D gradually increases in the order of region D1, region D2, region D3, and region D4. The rate of increase in emission luminance by the loading phenomenon is varied by variation in driving load. The present embodiment reduces the loading phenomenon and improves the image display quality in plasma display device 1. Processing of reducing the loading phenomenon is referred to as "loading correction".

Figure 7:
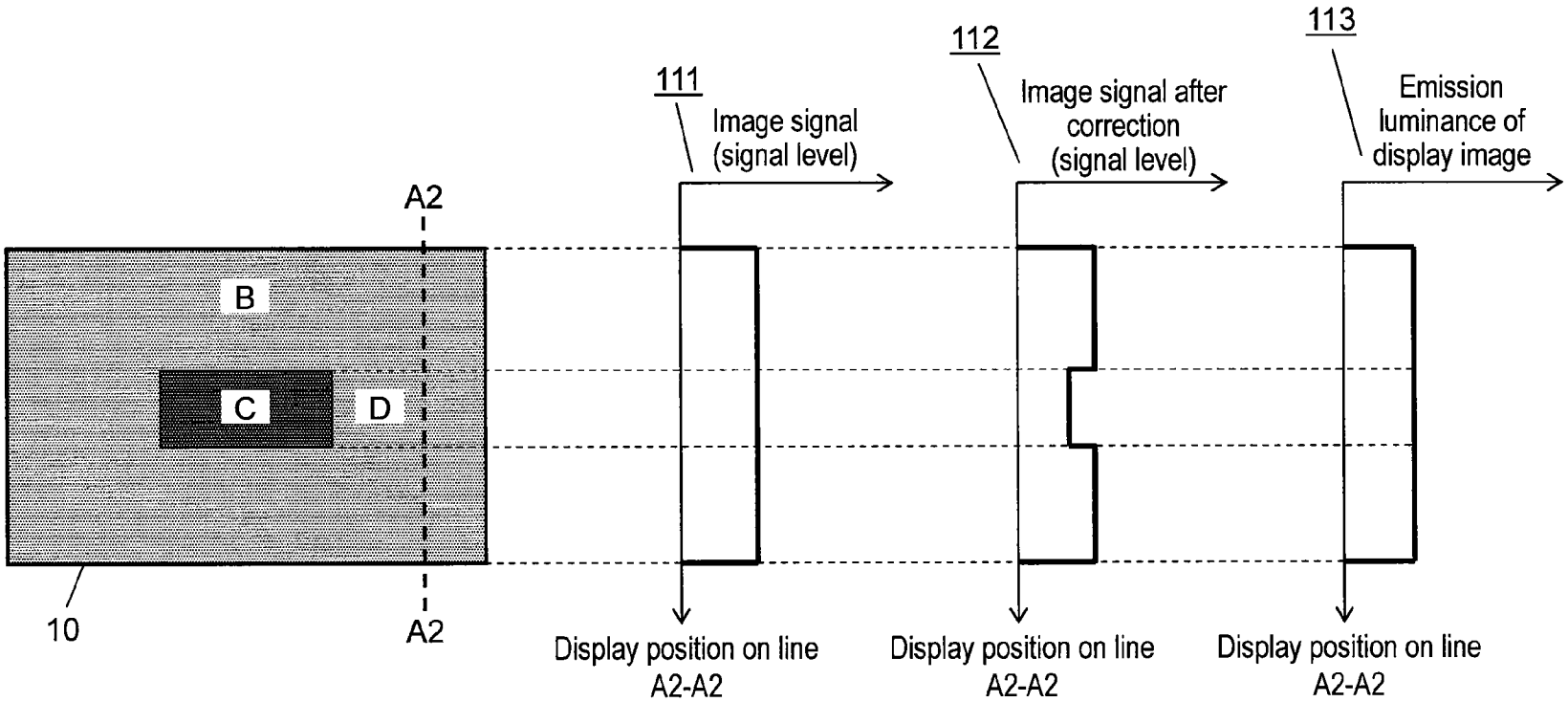
FIG. 7 is a diagram for schematically illustrating loading correction in accordance with the exemplary embodiment of the present invention.

FIG. 7 is a diagram for schematically illustrating the loading correction in accordance with the exemplary embodiment of the present invention. FIG. 7 shows the schematic diagram of the display image when "window pattern" of FIG. 5A is displayed on panel 10, signal level 111, signal level 112, and emission luminance 113. The display image shown on panel 10 of FIG. 7 is a schematic display image when "window pattern" of FIG. 5A is displayed on panel 10 after the loading correction of the present embodiment. Signal level 111 of FIG. 7 shows the signal level of the image signal on line A2-A2 on panel 10 of FIG. 7. The horizontal axis shows the height of the signal level of the image signal, and the vertical axis shows the display position on line A2-A2 on panel 10. Signal level 112 of FIG. 7 shows the signal level on line A2-A2 of the image signal after the loading correction of the present embodiment. The horizontal axis shows the height of the signal level of the image signal after the loading correction, and the vertical axis shows the display position on line A2-A2 on panel 10. Emission luminance 113 of FIG. 7 shows the emission luminance of the image signal on line A2-A2. The horizontal axis shows the height of the emission luminance of the display image, and the vertical axis shows the display position on line A2-A2 on panel 10.

In the present embodiment, the loading correction is performed by calculating a correction value based on the driving load of display electrode pairs 24 passing each discharge cell, and correcting the image signal. For example, when the image shown by panel 10 of FIG. 7 is displayed on panel 10, it can be determined that the signal level is the same in region B and region D, but display electrode pairs 24 passing region D also pass region C and hence the driving load is small. Therefore, the signal level in region D is corrected as shown by signal level 112 of FIG. 7. Thus, as shown by emission luminance 113 of FIG. 7, the height of the emission luminance in region B in the display image is made equal to that in region D, thereby reducing the loading phenomenon.

Thus, the loading phenomenon is reduced by correcting the image signal in a region where the loading phenomenon is expected to occur and by reducing the emission luminance of the display image in this region. At this time, in the present embodiment, the correction gain for loading correction is calculated based on the driving load and the position of the row direction of the discharge cell on panel 10, and the loading correction is performed using the correction gain.

Figure 8:
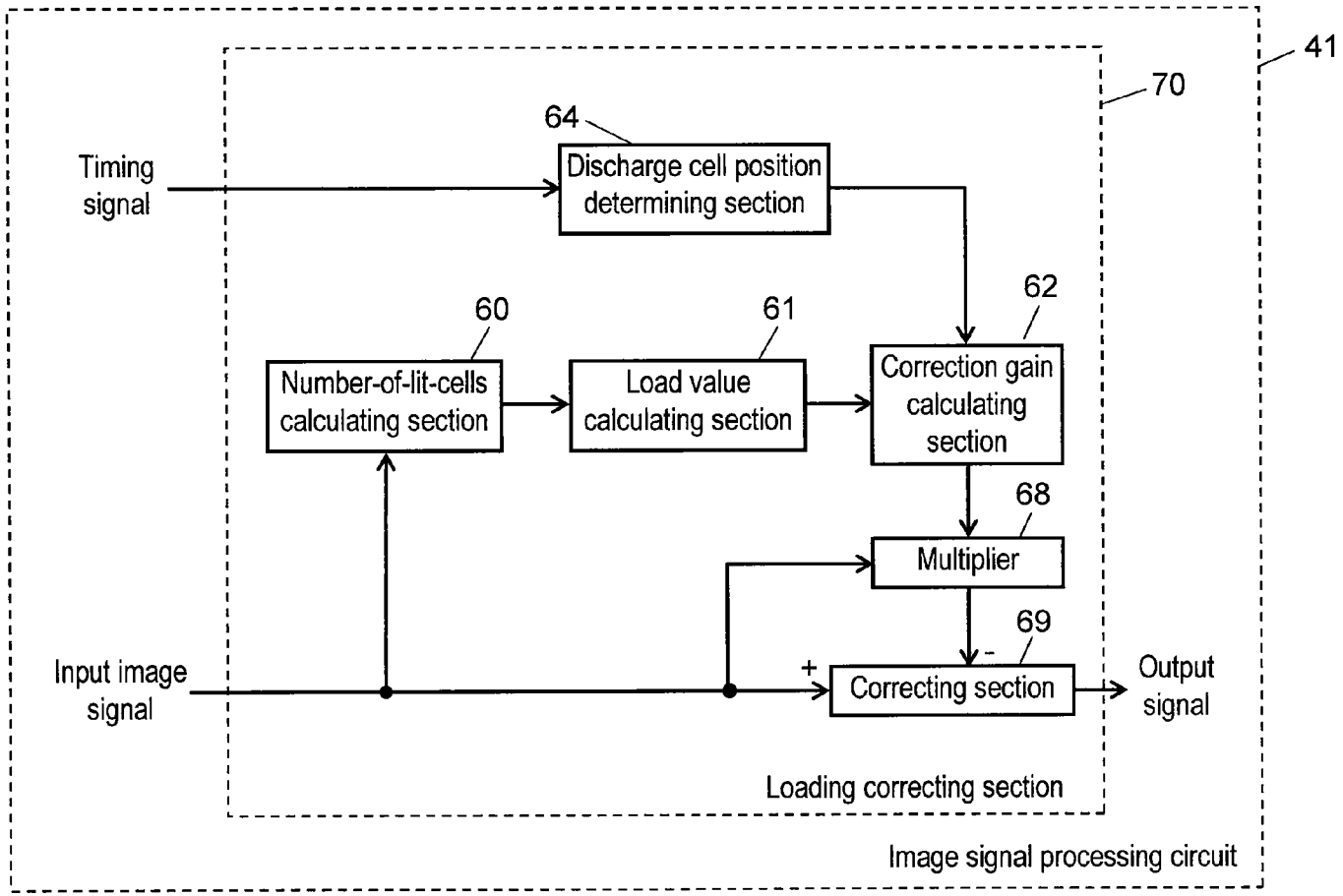
FIG. 8 is a circuit block diagram of an image signal processing circuit in accordance with the exemplary embodiment of the present invention.

The loading correction of the present embodiment is described in detail. FIG. 8 is a circuit block diagram of image signal processing circuit 41 in accordance with the exemplary embodiment of the present invention. FIG. 8 shows a block related to the loading correction in the present embodiment, and circuit blocks other than the block are omitted.

Image signal processing circuit 41 has loading correcting section 70. Loading correcting section 70 includes number-of-lit-cells calculating section 60, load value calculating section 61, correction gain calculating section 62, discharge cell position determining section 64, multiplier 68, and correcting section 69.

Number-of-lit-cells calculating section 60 calculates the number of discharge cells to be lit for each display electrode pair 24 in each subfield. Hereinafter, a discharge cell to be lit is referred to as "lit cell", and a discharge cell that is not to be lit is referred to as "unlit cell".

Load value calculating section 61 receives the calculation result by number-of-lit-cells calculating section 60, and performs operation based on a driving load calculating method of the present embodiment. In the present embodiment, the operation includes calculation of "load value" and "maximum load value".

Discharge cell position determining section 64 determines the position of the row direction of the discharge cell (hereinafter referred to as "target discharge cell") for which the correction gain is calculated by correction gain calculating section 62. Here, this position is a position of the extended direction of display electrode pairs 24.

Correction gain calculating section 62 calculates the correction gain based on the position determining result of the discharge cell by discharge cell position determining section 64 and the operation result by load value calculating section 61.

Multiplier 68 multiplies an image signal by the correction gain output from correction gain calculating section 62, and outputs the result as a correction signal. Correcting section 69 subtracts, from the image signal, the correction signal output from multiplier 68, and outputs the subtraction result as an image signal after correction.

Next, a calculating method of the correction gain of the present embodiment is described. In the present embodiment, this operation is performed by number-of-lit-cells calculating section 60, load value calculating section 61, discharge cell position determining section 64, and correction gain calculating section 62.

In the present embodiment, two numerical values referred to as "load value" and "maximum load value" based on the calculation result by number-of-lit-cells calculating section 60. "Load value" and "maximum load value" are numerical values used for estimating the occurring amount of the loading phenomenon in the target discharge cell.

Figure 9:
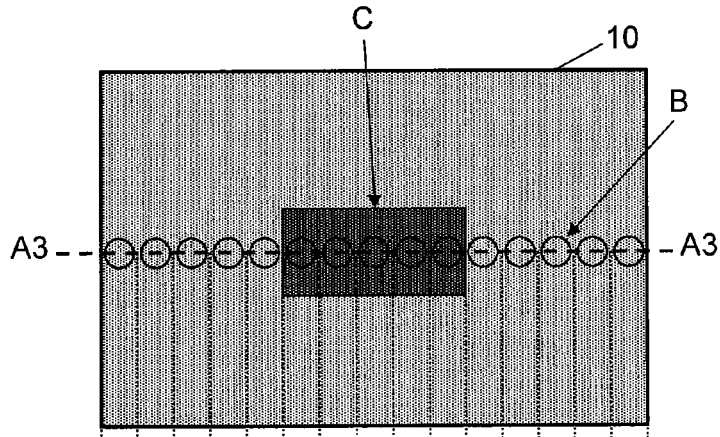
FIG. 9 is a schematic diagram for illustrating a calculating method of "load value" in accordance with the exemplary embodiment of the present invention.
Figure 10:
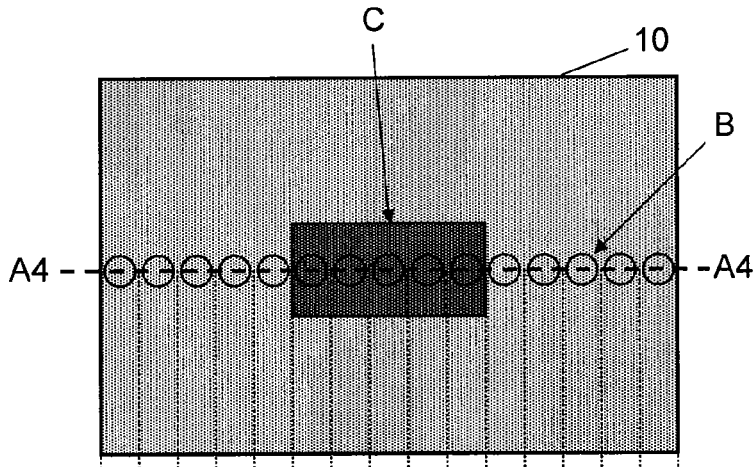
FIG. 10 is a schematic diagram for illustrating a calculating method of "maximum load value" in accordance with the exemplary embodiment of the present invention.

"Load value" of the present embodiment is firstly described using FIG. 9, and then "maximum load value" of the present embodiment is described using FIG. 10.

FIG. 9 is a schematic diagram for illustrating the calculating method of "load value" in accordance with the exemplary embodiment of the present invention. FIG. 9 shows a schematic diagram of the display image when "window pattern" of FIG. 5A is displayed on panel 10, lit state 121, and calculation value 122. Lit state 121 of FIG. 9 schematically shows the light emission or no light emission of each discharge cell on line A3-A3 on panel 10 of FIG. 9 in each subfield. The horizontal columns show display positions on line A3-A3 on panel 10, and the vertical columns show the subfields. "1" shows the light emission, and the blank columns show no light emission. Calculation value 122 of FIG. 9 schematically shows the calculating method of "load value" of the present embodiment. The horizontal columns show "number of lit cells", "luminance weight", "lit state of discharge cell B", and "calculation value". The vertical columns show the subfields. In the present embodiment, for simplifying the description, the number of discharge cells of the row direction is 15. Therefore, 15 discharge cells are disposed on line A3-A3 on panel 10 of FIG. 9. Actually, each following operation is performed based on the number (for example, 1920×3) of discharge cells of the row direction of panel 10.

The lit state in each subfield of 15 discharge cells disposed on line A3-A3 on panel 10 of FIG. 9 is a state shown by lit state 121, for example. In other words, in the central five discharge cells included in region C shown by panel 10 of FIG. 9, lighting is performed in the first SF through third SF and no-lighting is performed in the fourth SF through eighth SF. In the five right discharge cells and the five left discharge cells that are not included in region C, lighting is performed in the first SF through sixth SF and no-lighting is performed in the seventh SF through eighth SF.

When 15 discharge cells disposed on line A3-A3 are in such lit state, "load value" in one discharge cell of them, for example discharge cell B shown in FIG. 9, is determined as follows.

First, the number of lit sells in each subfield is calculated. Since all of 15 discharge cells on line A3-A3 are lit in the first SF through third SF, the number of lit cells in the first SF through third SF is "15" as shown in each column of "number of lit sells" in the first SF through third SF in calculation value 122 of FIG. 9. Since 10 discharge cells, of 15 discharge cells on line A3-A3, are lit in the fourth SF through sixth SF, the number of lit cells in the fourth SF through sixth SF is "10" as shown in each column of "number of lit sells" in the fourth SF through sixth SF in calculation value 122. Since none of 15 discharge cells on line A3-A3 is lit in the seventh SF through eighth SF, the number of lit cells in the seventh SF through eighth SF is "0" as shown in each column of "number of lit sells" in the seventh SF through eighth SF in calculation value 122.

Next, the number of lit cells in each subfield that has been determined in that manner is multiplied by the luminance weight of each subfield and the lit state of each subfield in discharge cell B. In the present embodiment, the luminance weights of respective subfields are set to (1, 2, 4, 8, 16, 32, 64, 128) sequentially from the first SF as shown in respective columns of "luminance weight" in the first SF through the eighth SF in calculation value 122 of FIG. 9. In the present embodiment, lighting is denoted with "1", and no lighting is denoted with "0". The lit states in discharge cell B are (1, 1, 1, 1, 1, 1, 0, 0) sequentially from the first SF as shown in respective columns of "lit state in discharge cell B" in the first SF through the eighth SF in calculation value 122. The multiplication results are (15, 30, 60, 80, 160, 320, 0, 0) sequentially from the first SF as shown in respective columns of "calculation value" in the first SF through the eighth SF in calculation value 122. Then, the sum total of the calculation values is determined. In the example shown in calculation value 122 of FIG. 9, the sum total of the calculation values is 665. The sum total becomes "load value" in discharge cell B. In the present embodiment, such operation is applied to each discharge cell to provide "load value" in each discharge cell.

FIG. 10 is a schematic diagram for illustrating a calculating method of "maximum load value" in accordance with the exemplary embodiment of the present invention. FIG. 10 shows a schematic diagram of the display image when "window pattern" of FIG. 5A is displayed on panel 10, lit state 131, and calculation value 132. Lit state 131 of FIG. 10 schematically shows the light emission or no light emission when the lit state in discharge cell B is assigned to all discharge cells on line A4-A4 on panel 10 of FIG. 10 in each subfield for calculation of the "maximum load value". The horizontal columns show the display positions on line A4-A4 on panel 10, and the vertical columns show the subfields. Calculation value 132 of FIG. 10 schematically shows the calculating method of "maximum load value" of the present embodiment. The horizontal columns show "number of lit cells", "luminance weight", "lit state of discharge cell B", and "calculation value" sequentially from the left of FIG. 10. The vertical columns show the subfields.

In the present embodiment, "maximum load value" is calculated as follows. For example, when "maximum load value" in discharge cell B is calculated, it is assumed that all discharge cells on line A4-A4 are lit in the same state as that in discharge cell B as shown in lit state 131 of FIG. 10, and the number of lit cells in each subfield is calculated. Since the lit states of respective subfields in discharge cell B are (1, 1, 1, 1, 1, 1, 0, 0) sequentially from the first SF as shown in respective columns of "lit state in discharge cell B" in the first SF through the eighth SF in calculation value 122 of FIG. 9, the lit states are assigned to all discharge cells on line A4-A4. Therefore, the lit states of all discharge cells on line A4-A4 are "1" in the first SF through sixth SF, and "0" in the seventh SF and eighth SF as shown in lit state 131 of FIG. 10. Therefore, the numbers of lit cells are (15, 15, 15, 15, 15, 15, 0, 0) sequentially from the first SF as shown in respective columns of "number of lit cells" in the first SF through the eighth SF in calculation value 132. In the present embodiment, however, each discharge cell on line A4-A4 is not actually put into the lit state shown in lit state 131. The lit state shown in lit state 131 shows the lit state when each discharge cell is assumed to come into the same lit state as that in discharge cell B in order to calculate "maximum load value". The "number of lit cells" shown in calculation value 132 is obtained by calculating the number of lit cells under the assumption.

Next, the number of lit cells in each subfield that has been determined in that manner is multiplied by the luminance weight of each subfield and the lit state of each subfield in discharge cell B. In the present embodiment, the luminance weights of respective subfields are set to (1, 2, 4, 8, 16, 32, 64, 128) sequentially from the first SF, as shown in respective columns of "luminance weight" in the first SF through the eighth SF in calculation value 132 of FIG. 10. The lit states in discharge cell B are (1, 1, 1, 1, 1, 1, 0, 0) sequentially from the first SF as shown in respective columns of "lit state in discharge cell B" in the first SF through the eighth SF in calculation value 132. The multiplication results are (15, 30, 60, 120, 240, 480, 0, 0) sequentially from the first SF as shown in respective columns of "calculation value" in the first SF through the eighth SF in calculation value 132. Then, the sum total of the calculation values is determined. In the example shown in calculation value 132 of FIG. 10, the sum total of the calculation values is 945. This sum total becomes "maximum load value" in discharge cell B. In the present embodiment, such operation is applied to each discharge cell to provide "maximum load value" in each discharge cell.

The "maximum load value" in discharge cell B may be calculated by the following steps:

- multiplying the total number of discharge cells (15, in this example) formed on display electrode pairs 24 by luminance weights (for example, (1, 2, 4, 8, 16, 32, 64, 128) sequentially from the first SF) of respective subfields;
- multiplying the multiplication result by the lit states (for example, (1, 1, 1, 1, 1, 1, 0, 0) sequentially from the first SF) of respective subfields in discharge cell B; and
- determining the sum total of the calculation values (for example, (15, 30, 60, 120, 240, 480, 0, 0) sequentially from the first SF).

This calculating method also allows the result (945 in this example) similar to that of the above-mentioned operation.

In the present embodiment, the correction gain in the target discharge cell (discharge cell B) is calculated using a numerical value obtained from $$(\text{maximum load value} - \text{load value})/\text{maximum load value} \qquad \text{equation (1)}$$

For example, when "load value" is 665 and "maximum load value" is 945 in discharge cell B as discussed above, a numerical value can be obtained from $$(945-665)/945=0.296$$

The correction gain is calculated by applying the calculated numerical value to equation (2). In other words, correction gain is calculated by multiplying the result of equation (1) by a predetermined coefficient (predetermined coefficient in response to a characteristic or the like of panel 10), and multiplying the multiplication result by a predetermined correction amount based on the position of the row direction of the discharge cell in panel 10. Here, equation (2) is expressed as follows:

$$\text{Correction gain} = \text{result of equation (1)} \times \text{predetermined coefficient} \times \text{correction amount} \qquad \text{equation (2)}$$

Then, the correction gain is substituted into equation (3) to correct an input image signal. Here, equation (3) is expressed as follows:

$$\text{Output image signal} = \text{input image signal} - \text{input image signal} \times \text{correction gain} \qquad \text{equation (3)}$$

Thus, unnecessary luminance increase is suppressed in a region where a loading phenomenon is expected to occur, and the loading phenomenon can be reduced.

In panel 10 where the screen has been recently enlarged and the definition has been enhanced, the impedance of scan electrodes 22 and sustain electrodes 23 increases, and the difference in voltage drop of a sustain pulse is apt to largely increase between a discharge cell existing at a position relatively close to the driving circuit and a discharge cell existing at a position relatively far from the driving circuit. In the present embodiment, "load value" and "maximum load value" are calculated, the correction amount based on the position of the row direction of the discharge cell in panel 10 is previously set, and they are used for calculating the correction gain. Thus, the correction gain responsive to the expected increase in emission luminance can be accurately calculated, and the loading correction can be performed further accurately.

Figure 11:
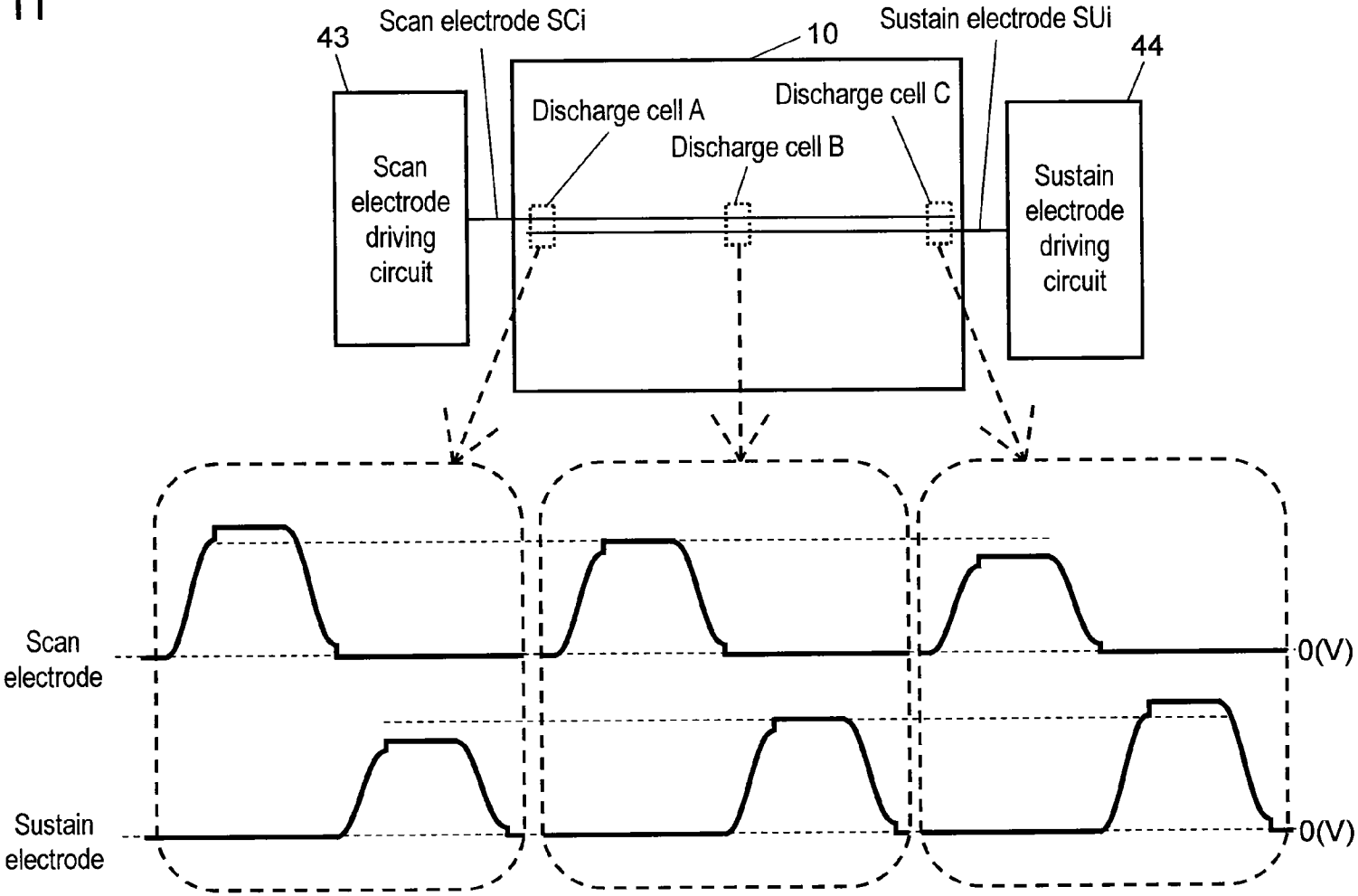
FIG. 11 is a diagram for schematically illustrating difference in voltage drop of a sustain pulse based on the position of the row direction of a discharge cell in the panel.

FIG. 11 is a diagram for schematically illustrating the difference in voltage drop of a sustain pulse based on the position of the row direction of a discharge cell in panel 10. For simplifying the description, FIG. 11 shows only one of display electrode pairs 24. FIG. 11 schematically shows sustain pulses in three discharge cells, namely discharge cell A formed at a position relatively close to scan electrode driving circuit 43, discharge cell C formed at a position relatively far from scan electrode driving circuit 43, and discharge cell B formed at an intermediate position.

As shown in FIG. 11, discharge cell A formed at the position relatively close to scan electrode driving circuit 43 is relatively far from sustain electrode driving circuit 44. Therefore, the driving impedance of discharge cell A in the view from scan electrode driving circuit 43 is relatively low, and the driving impedance of discharge cell A in the view from sustain electrode driving circuit 44 is relatively high. Therefore, as shown in FIG. 11, the voltage drop of the sustain pulse applied from scan electrode driving circuit 43 to discharge cell A is relatively low, and the voltage drop of the sustain pulse applied from sustain electrode driving circuit 44 to discharge cell A is relatively high.

While, discharge cell C formed at a position relatively far from scan electrode driving circuit 43 is relatively close to sustain electrode driving circuit 44. Therefore, the voltage drop of the sustain pulse applied from scan electrode driving circuit 43 to discharge cell C is relatively high, and the voltage drop of the sustain pulse applied from sustain electrode driving circuit 44 to discharge cell C is relatively low. The sustain pulse applied to discharge cell B has a substantially intermediate magnitude.

The emission luminance by the sustain discharge varies in response to the magnitude of the sustain pulse. As the sustain pulse increases, stronger sustain discharge generally occurs and the emission luminance also increases. As the sustain pulse decreases, the sustain discharge becomes weak and unstable, and the emission luminance also decreases.

The emission luminance (emission luminance in discharge cell A and discharge cell C, for example) caused by combining a sustain pulse having a relatively large amplitude and a sustain pulse having a relatively small amplitude can be different from the emission luminance (for example, emission luminance in discharge cell B) caused by the sustain pulse having the intermediate amplitude. However, which is brighter depends on the characteristic of panel 10. The emission luminance in discharge cell A can become different from the emission luminance in discharge cell C dependently on the configuration of the driving circuit and the characteristic of panel 10.

For example, when the emission luminance in discharge cell A is lower than that in discharge cell B, it is preferable to make the correction gain used for the loading correction smaller in discharge cell A than in discharge cell B. When the emission luminance in discharge cell B is lower than that in discharge cell A, it is preferable to make the correction gain used for the loading correction smaller in discharge cell B than in discharge cell A.

In the present embodiment, the correction gain is calculated using the correction amount based on the position of the row direction of the discharge cell, and the correction gain is used for loading correction.

Figure 12:
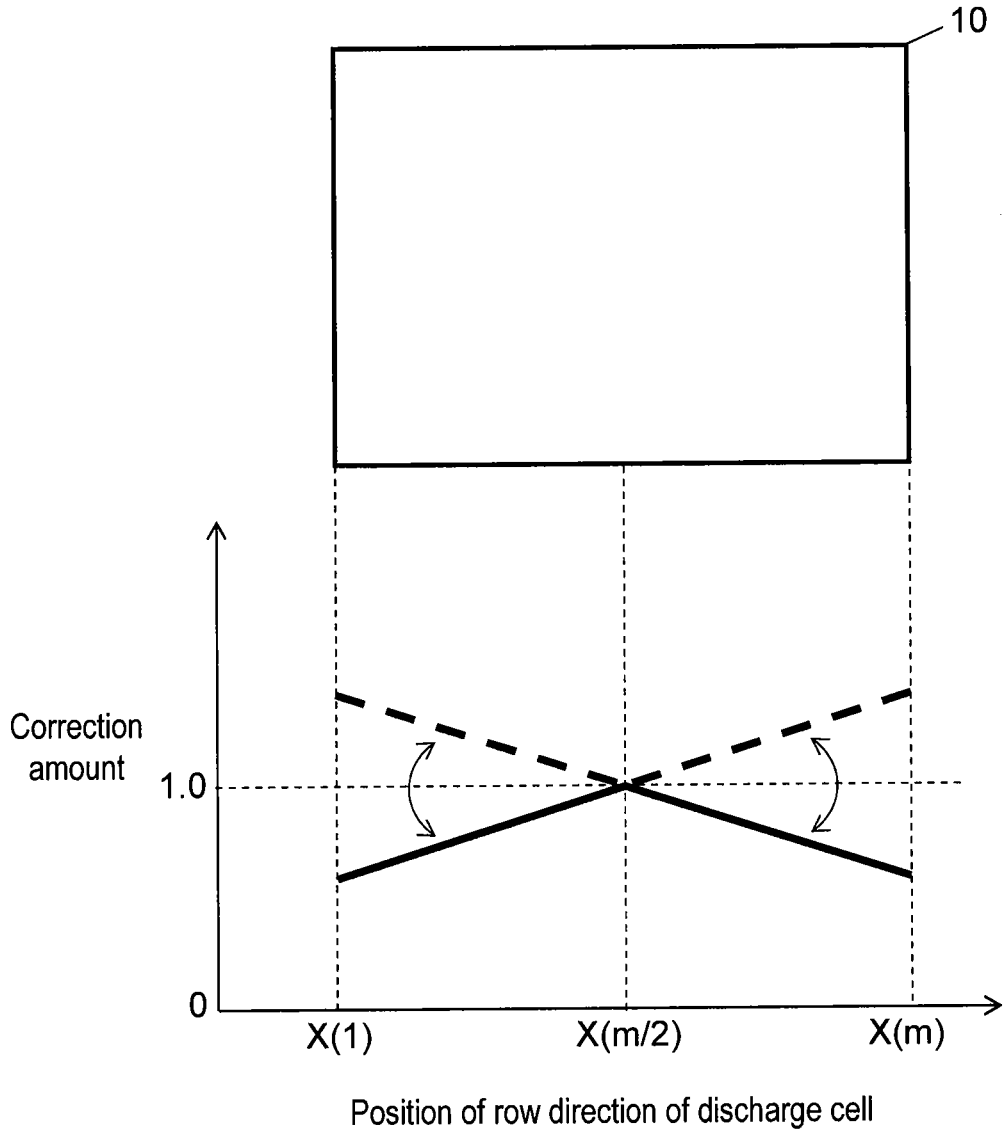
FIG. 12 is a diagram for schematically illustrating correction amount based on the position of the row direction of a discharge cell in accordance with the exemplary embodiment of the present invention.

FIG. 12 is a diagram for schematically illustrating the correction amount based on the position of the row direction of the discharge cell in accordance with the exemplary embodiment of the present invention.

For example, the correction amount is set to decrease toward both ends of panel 10 as shown in the solid line of FIG. 12 in plasma display device 1 having the following characteristic. In this characteristic, the emission luminance is lower in the discharge cells (for example, discharge cells positioned at X(1) and X(m) of FIG. 12) existing at both ends of panel 10 than in the discharge cell (for example, discharge cell positioned at X(m/2)) existing in the center of panel 10. The correction amount is determined based on the position of the row direction of the target discharge cell, and the correction gain is calculated. Thus, the correction gain can be gradually decreased from the center toward both ends of panel 10, and hence the loading correction can be decreased from the center toward the both ends of panel 10.

Alternately, the correction amount is set to increase toward both ends of panel 10 as shown in the broken line of FIG. 12 in plasma display device 1 having the following characteristic. In this characteristic, the emission luminance is lower in the discharge cell (for example, discharge cell positioned at X(m/2) of FIG. 12) existing in the center of panel 10 than in the discharge cells (for example, discharge cells positioned at X(1) and X(m) existing at both ends of panel 10. Thus, the correction gain can be gradually decreased from the both ends toward the center of panel 10, and hence the loading correction can be decreased from the both ends toward the center of panel 10.

Even in panel 10 that can cause, due to its high definition and large screen, a large difference in voltage drop of the sustain pulse between the discharge cells formed on the same display electrode pairs 24 and can cause variation in emission luminance, the optimal loading correction can be performed in response to the position of the row direction of the discharge cells, and the display luminance can be uniformed and the image display quality can be improved.

In the present embodiment, data of the correction amount shown in FIG. 12 is stored, in a storage section (not shown), as a data conversion table for outputting the correction amount corresponding to the information output from a discharge cell position determining section 64, and is disposed in correction gain calculating section 62.

The correction amount shown in FIG. 12 may be set based on the difference in emission luminance between the discharge cells formed on the same display electrode pairs 24. For example, the correction amount may be set so as to satisfy the following condition: when the emission luminance of the discharge cells existing at the both ends of panel 10 is lower than that of the discharge cell existing in the center of panel 10 by 5%, the correction gain of the discharge cells existing at the both ends of panel 10 is lower than that of the discharge cell existing in the center of panel 10 by 5%.

The variation in correction amount shown in FIG. 12 may be expressed by a straight line such as the solid line or broken line of FIG. 12, or may be expressed by a quadratic curve or another curve. Here, preferably, the correction amount is varied in the pixel unit, and is set so that three discharge cells of R, G, and B constituting one pixel have the same correction amount.

In the present embodiment, FIG. 12 shows a structure where the correction amount is set to be bilaterally symmetric with respect to the discharge cell existing in the center of panel 10. However, the present invention is not limited to this structure. The variation in correction amount may be set to be bilaterally asymmetric with respect to the discharge cell existing in the center of panel 10. The variation on one side may be expressed by a straight line, or the variation on the other side may be expressed by a quadratic curve or another curve. The position shifted right or left from the discharge cell existing in the center of panel 10 may be set as the variation point of the correction amount. The correction amount shown in FIG. 12 is set optimally in response to the characteristic of the panel 10 or the specification of plasma display device 1.

In FIG. 12, the correction amount of the discharge cell (for example, discharge cell positioned at X(m/2) of FIG. 12) existing in the center of panel 10 is 1.0. This is simply because a predetermined coefficient used in calculating the correction gain shown in equation (2) is set so that the correction amount of the discharge cell existing in the center of panel 10 is 1.0. In the present invention, the correction amount set based on the position of the discharge cell is not limited to the numerical value of FIG. 12, and it is preferable to optimally set it in response to the characteristic of the panel 10 or the specification of plasma display device 1.

As discussed above, in the present embodiment, "load value" and "maximum load value" are calculated for each discharge cell, and the correction gain is calculated using the correction amount based on the position of the discharge cell. Thus, even in plasma display device 1 having panel 10 where large difference in voltage drop of the sustain pulse occurs between the discharge cells formed on the same display electrode pairs 24, the correction gain responsive to the position of the row direction of the discharge cell can be calculated. When an image expected to cause a loading phenomenon is displayed on panel 10, therefore, further accurate loading correction can be performed in response to the expected increase in emission luminance. Even in plasma display device 1 having high-definition panel 10 having a large screen, the display luminance can be uniformed and the image display quality can be improved.

In the present embodiment, when "load value" and "maximum load value" are calculated, the luminance weight of each subfield is multiplied by the lit state of each subfield in the discharge cell. However, the number of sustain pulses of each subfield may be used instead of the luminance weight, for example.

When a generally used image processing called error diffusion is performed, the following problems can occur: the error amount diffused at a change point (boundary of a pattern of the display image) of a gradation value increases, and the boundary in the boundary part where variation in luminance is large is emphasized and is seen unnaturally. In order to reduce the problems, the correction value for error diffusion may be randomly added to or subtracted from the calculated correction gain, and the correction gain may be varied randomly. Such processing can reduce the problem where the boundary of the pattern is emphasized and is seen unnaturally.

Figure 13:
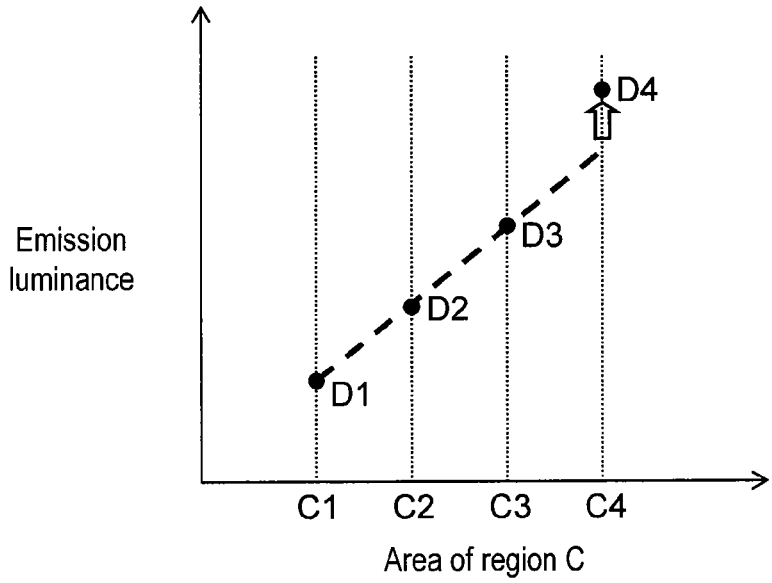
FIG. 13 is a diagram showing one example of the relationship between the area of region C and emission luminance of region D in "window pattern".
Figure 14:
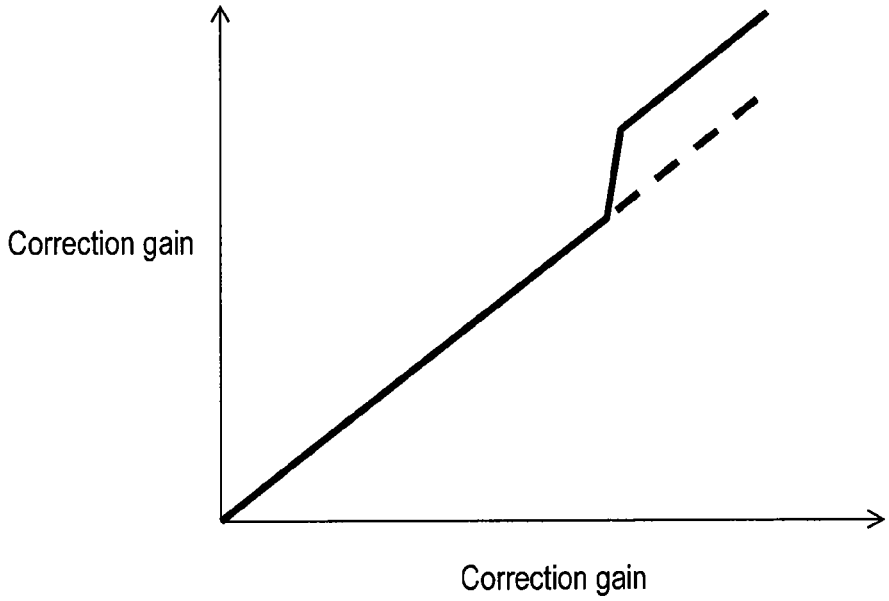
FIG. 14 is a characteristic diagram showing one example of nonlinear processing of correction gain in accordance with the exemplary embodiment of the present invention.

In FIG. 6A, FIG. 6B, FIG. 6C, and FIG. 6D, the example where variation in driving load varies the emission luminance has been described. Dependently on the characteristic of panel 10, however, the emission luminance does not vary linearly whenever the loading phenomenon occurs. FIG. 13 shows one example of the relationship between the area of region C and the emission luminance of region D in "window pattern" shown in FIG. 6A, FIG. 6B, FIG. 6C, and FIG. 6D. In some panel 10, however, the loading phenomenon can extremely degrade and the emission luminance of region D can increase largely (for example, D4 of FIG. 6D) when the area of region C increases (for example, C4 of FIG. 6D), namely when the driving load of display electrode pairs 24 decreases. The correction gain may be weighted in response to the characteristic of panel 10, and the correction gain may be varied nonlinearly. FIG. 14 is a characteristic diagram showing one example of nonlinear processing of the correction gain in accordance with the exemplary embodiment of the present invention. For example, the correction gain can be set nonlinearly as shown in FIG. 14 by previously storing, in a look-up table, a plurality of correction gains set in response to the characteristic of panel 10, and by reading the correction gain from the look-up table based on the calculation result of the correction gain.

In the exemplary embodiment of the present invention, luminance weight is used for calculating the load value. For example, the number of sustain pulses is used instead of the luminance weight.

The exemplary embodiment of the present invention can be also applied to the driving method of the panel by the so-called two-phase driving and can produce the same effect as the above-mentioned effect. In this driving method, scan electrode SC1 through scan electrode SCn are divided into a first scan electrode group and a second scan electrode group, and the address period is constituted by a first address period and a second address period. In the first address period, a scan pulse is applied to each of the scan electrodes belonging to the first scan electrode group. In the second address period, a scan pulse is applied to each of the scan electrodes belonging to the second scan electrode group.

The exemplary embodiment of the present invention is effective even in a panel having the electrode structure where one scan electrode is adjacent to another scan electrode and one sustain electrode is adjacent to another sustain electrode. In other words, in this electrode structure, an array of the electrodes disposed on the front plate is " . . . , scan electrode, scan electrode, sustain electrode, sustain electrode, scan electrode, scan electrode, . . . " (referred to as "ABBA electrode structure").

Each specific numerical value shown in the present embodiment is set based on the characteristic of a 50-inch panel having 1080 display electrode pairs, and is simply one example in the embodiment. The present invention is not limited to these numerical values. Numerical values are preferably set optimally in response to the characteristic of the panel or the specification of the plasma display device. These numerical values can vary in a range allowing the above-mentioned effect.

Industrial Applicability

The present invention can provide a plasma display device and a driving method for a panel capable of improving the image display quality by uniforming the display luminance even in a high-definition panel having a large screen. Therefore, the present invention is useful as a plasma display device and a driving method for a panel.

REFERENCE MARKS IN THE DRAWINGS

1 plasma display device
10 panel (plasma display panel)
21 front plate
22 scan electrode
23 sustain electrode
24 display electrode pair
25, 33 dielectric layer
26 protective layer
31 rear plate
32 data electrode
34 barrier rib
35 phosphor layer
41 image signal processing circuit
42 data electrode driving circuit
43 scan electrode driving circuit
44 sustain electrode driving circuit

45 timing generating circuit
60 number-of-lit-cells calculating section
61 load value calculating section
62 correction gain calculating section
64 discharge cell position determining section
68 multiplier
69 correcting section
70 loading correcting section
101, 111, 112 signal level
102, 113 emission luminance
121, 131 lit state
122, 132 calculation value

The invention claimed is:

1. A plasma display device comprising:

a plasma display panel that is driven by a subfield method and has a plurality of discharge cells, each of the discharge cells having a display electrode pair that includes a scan electrode and a sustain electrode, wherein, in the subfield method, a plurality of subfields having an initializing period, an address period, and a sustain period is disposed in one field, a luminance weight is set for each subfield, and as many sustain pulses as the number corresponding to the luminance weight are generated in the sustain period, thereby performing gradation display; and an image signal processing circuit for converting an input image signal into image data that indicates light emission or no light emission for each subfield in the discharge cells, wherein the image signal processing circuit includes a number-of-lit-cells calculating section for calculating the number of cells to be lit for each display electrode pair in each subfield;

a load value calculating section for calculating a load value of each discharge cell based on a calculation result by the number-of-lit-cells calculating section;

a correction gain calculating section for calculating correction gain of each discharge cell based on a calculation result by the load value calculating section and positions of the discharge cells; and a correcting section for subtracting, from the input image signal, a result derived by multiplying the input image signal by an output from the correction gain calculating section, wherein the load value calculating section and the correction gain calculating section perform a process comprising:

setting lit states of the discharge cells in each subfield where lighting is denoted with 1 and no-lighting is denoted with 0;

multiplying the calculation result obtained by the number-of-lit-cells calculating section by a luminance weight set for each subfield and the lit state of the discharge cell whose correction gain is calculated, and calculating the total sum as the load value;

multiplying the number of the discharge cells formed on the display electrode pair by the luminance weight set for each subfield and the lit state in the discharge cell whose correction gain is calculated, and calculating the total sum as a maximum load value; and subtracting the load value from the maximum load value to obtain a subtraction result, and dividing the subtraction result by the maximum load value, thereby calculating the correction gain.

2. A driving method for a plasma display panel for driving, by a subfield method, the plasma display panel that has a plurality of discharge cells, each of the discharge cells having a display electrode pair that includes a scan electrode and a sustain electrode, wherein, in the subfield method, a plurality of subfields having an initializing period, an address period, and a sustain period is disposed in one field, a luminance weight is set for each subfield, and as many sustain pulses as the number corresponding to the luminance weight are generated in the sustain period, thereby performing gradation display, the driving method comprises:

calculating the number of cells to be lit for each display electrode pair in each subfield;

calculating a load value of each discharge cell based on the number of cells to be lit, and calculating correction gain of each discharge cell based on the load value and positions of the discharge cells; and multiplying the input image signal by the correction gain and subtracting a multiplication result from the input image signal, setting lit states of the discharge cells in each subfield where lighting is denoted with 1 and no-lighting is denoted with 0;

multiplying the calculation result obtained by the number-of-lit-cells calculating section by a luminance weight set for each subfield and the lit state of the discharge cell whose correction gain is calculated, and calculating the total sum as the load value;

multiplying the number of the discharge cells formed on the display electrode pair by the luminance weight set for each subfield and the lit state in the discharge cell whose correction gain is calculated, and calculating the total sum as a maximum load value; and subtracting the load value from the maximum load value to obtain a subtraction result, and dividing the subtraction result by the maximum load value, thereby calculating the correction gain.

* * * * *